US007789731B2

(12) United States Patent
Hoglund

(10) Patent No.: US 7,789,731 B2
(45) Date of Patent: Sep. 7, 2010

(54) OSCILLATING GRINDING MACHINE

(75) Inventor: Goran Hoglund, Nykarleby (FI)

(73) Assignee: OY KWH Mirka AB (FI)

( * ) Notice: Subject to any disclaimer, the term of this patent is extended or adjusted under 35 U.S.C. 154(b) by 0 days.

(21) Appl. No.: 12/262,817

(22) Filed: Oct. 31, 2008

(65) Prior Publication Data

US 2009/0124179 A1 May 14, 2009

Related U.S. Application Data

(63) Continuation of application No. 11/709,422, filed on Feb. 22, 2007, now Pat. No. 7,540,801.

(30) Foreign Application Priority Data

Feb. 23, 2006 (FI) ..... 20065131

(51) Int. Cl.
*B24B 49/00* (2006.01)

(52) U.S. Cl. ..... 451/11; 451/159

(58) Field of Classification Search ..... 451/11, 451/270, 357, 159, 921
See application file for complete search history.

(56) References Cited

U.S. PATENT DOCUMENTS

| | | | | |
|---|---|---|---|---|
| 348,225 | A | 8/1886 | Maloy | |
| 675,055 | A | 5/1901 | Durouaux | |
| 1,824,559 | A | 9/1931 | McCabe | |
| 2,032,382 | A | 3/1936 | Torrison | |
| 2,371,303 | A | 3/1945 | Liebowitz | |
| 3,482,362 | A * | 12/1969 | Bangerter et al. | 451/357 |
| 3,579,915 | A * | 5/1971 | Satterthwaite et al. | 451/271 |
| 3,583,111 | A * | 6/1971 | Volk | 451/490 |
| 3,893,264 | A | 7/1975 | Behnke | |
| 3,900,972 | A | 8/1975 | Rupp | |
| 4,186,528 | A | 2/1980 | Yascheritsyn et al. | |
| 4,392,331 | A | 7/1983 | Schimitzek et al. | |
| 4,419,846 | A | 12/1983 | Schimitzek et al. | |
| 4,555,229 | A | 11/1985 | Biadigo et al. | |
| 5,070,654 | A | 12/1991 | Manqvist et al. | |
| 5,993,304 | A | 11/1999 | Eriksson | |
| 6,089,963 | A | 7/2000 | Wiand et al. | |
| 6,500,055 | B1 | 12/2002 | Adams et al. | |
| 7,104,873 | B1 | 9/2006 | Borinato et al. | |
| 2005/0221721 | A1 * | 10/2005 | Valle et al. | 451/11 |

FOREIGN PATENT DOCUMENTS

| | | |
|---|---|---|
| DE | 2430620 | 2/1975 |
| GB | 2403171 | 12/2004 |

* cited by examiner

*Primary Examiner*—Maurina Rachuba
(74) *Attorney, Agent, or Firm*—Altera Law Group, LLC

(57) ABSTRACT

The present invention relates particularly to an oscillating grinding machine. The grinding machine comprises a driving motor (3) surrounded by a body (3), and a drive shaft (4) cooperating with the driving motor. The drive shaft comprises a grinding head (5) that constitutes a support for a grinding product (8). The drive shaft (4) is arranged in two pieces and comprises a main shaft (11) and an eccentric shaft (10) arranged rigidly thereto. The eccentric shaft comprises a center line (12) that assumes an angle ($\alpha$) against a corresponding center line (13) of the main shaft, and thus the grinding head (5) will assume an eccentric placement in relation to the main shaft (11). Thus, the grinding head is arranged to oscillate in a substantially spherical plane provided by the rotation of the main shaft and the eccentricity and inclination of the eccentric shaft in relation to the main shaft.

21 Claims, 2 Drawing Sheets

OSCILLATING GRINDING MACHINE

TECHNICAL FIELD

Figure 1:
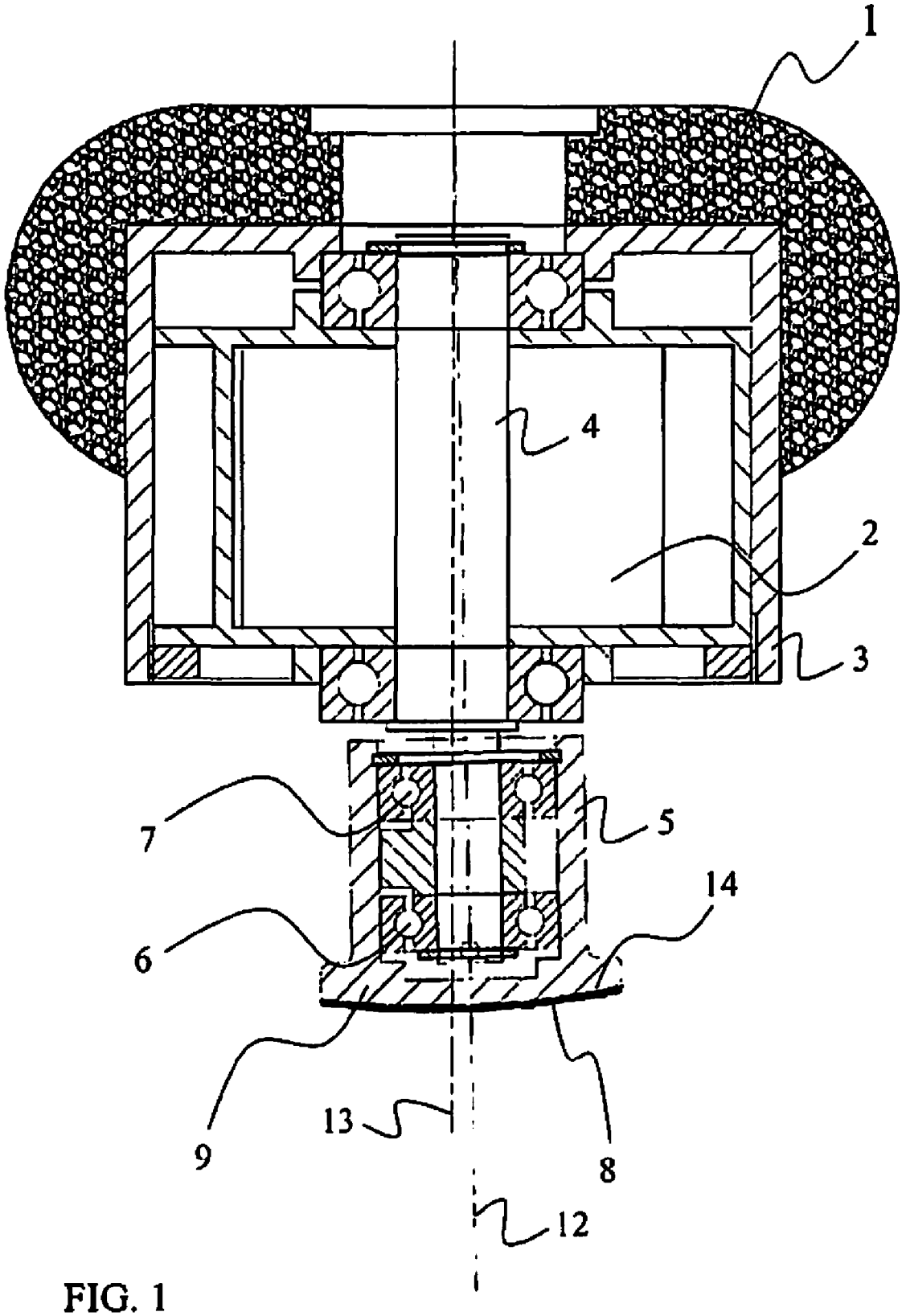

The present invention relates to an oscillating grinding machine according to the preamble of claim 1 that generates a spherical oscillation. The machine is primarily intended for grinding small defects in colour and lacquer with abrasive discs or the like grinding products that have a small dimension, but the invention can also be utilized for grinding products having surfaces with a concave or convex cap form.

PRIOR ART

It is generally known to perform grinding with different types of oscillating tools in repairing work involving colour or lacquer damage. Because such repairing work often relates to the machining of surfaces having small areas, the work is preferably performed with easily handled manually operated grinding machines. For the execution of the work, a grinding product, for example an abrasive disc, is fastened to the upper surface of a fastening plate that is comprised by the tool and caused to oscillate through an eccentric operating in the tool, for example. In known machines, the extension of this upper surface is substantially two-dimensional.

Grinding machines provided with a circular fastening plate made for abrasive discs comprise a fastening sleeve for the oscillating fastening plate. Such a fastening sleeve is preferably mounted in bearings to the shaft of the grinding machine such that the fastening plate is able to rotate freely around its shaft, and can at the same time be made to oscillate through the eccentric. The abrasive disc fastened to the fastening plate thus assumes a movement composed partly of a substantially circular oscillation and partly of a free rotation relative to the shaft of the fastening sleeve. Consequently, during the grinding work, the movement of such an abrasive disc takes place in only two dimensions that coincide with the plane of the fastening plate.

During a grinding work, the rotation of the grinding product is affected by the friction generated between the grinding product and by the grinding area against which the tool is directed. The reclination angle and the pressure with which the grinding product is applied against the grinding area also generate an effect.

During grinding of painted or lacquered surfaces for the improvement of small surface defects, for example, the aim is often to restrict the area to be ground to avoid undesired sharp borders between ground and non-ground areas. The problem in known grinding machines that comprise the above-described two-dimensional and plane oscillation movement is that the outer edge of the grinding product is grinding significantly more efficiently than the middle area of the grinding product. This further increases the difficulty of repairing said surface defects.

A grinding machine of the above type also often tends to be unsteady or sway. This is because the oscillation movement of the fastening plate pulls the grinding machine laterally in the low-lying contact plane where the grinding product meets the grinding area. The user of the grinding machine who supports the grinding machine with his hand at a more remote upper plane has no time to prevent the lateral movements of the grinding machine to a sufficient degree. The insufficient prevention causes the grinding machine to sway, which, in turn, leads to a situation wherein the fastening plate and the grinding product fastened thereto cannot at all times bear completely straight against the surface to be ground.

The problems of these uneven grinding results are further accentuated by the difficulty at the start of the grinding work to dispose the fastening plane of the grinding machine with the grinding product completely straight against the surface to be ground.

The result of all these above problems and shortcomings is that new surface defects in the form of finishing defects are often created during a grinding work with known oscillating tools. These finishing defects comprise crater-like recesses at the outer edge of the grinding area. In points of these crater-like recesses, the grinding area comprises outer areas that are deeper and that surround the centre parts that are less ground. In case the oscillating tool has also been obliquely positioned during the work, semilunar craters are in stead created, wherein deeper outer areas only partly surround smaller ground centre parts.

These finishing defects are particularly troublesome when an attempt is made to remove a small defect in the surface lacquering of a car, for example. In this case, the intent is only to polish off any smaller defects after the final lacquering without having to correct-lacquer the treated area afterwards. In this repairing work the intent is to grind an as small area as possible and at the same time to obtain a smooth interface between the newly ground area of the lacquering and the surrounding non-ground area.

On the other hand, oscillating grinding machines are known according to patent DE 24 30 620. Such a machine is constructed for use in so-called lapping, i.e. a slow grinding of hard materials. The patent discloses a detailed construction with an adjustable drive shaft, which renders the machine both difficult to balance and difficult to implement. The contemplated area of use of the machine results in a construction that renders it impossible to utilize the grinding machine in grinding at very high speeds of rotation. A machine of this construction is also intended to utilize nonflexible abrasive products.

Approach to the Problem

The present invention allows the problems of known solutions to be substantially avoided. The object of the invention is thus to provide an easily handled grinding machine that includes a spherical oscillation with a high reliability in operation. Such a grinding machine enables also a reduction in the size of the grinding area and a smoother interface between a ground and non-ground area.

This object is solved in accordance with the present invention by the grinding machine comprising the characteristics stated in the characterizing part of claim 1. The subsequent independent claims describe suitable further developments and variations of the invention that further improve the operation thereof.

The invention thus relates primarily to the achievement of a substantially spherical movement of the oscillating movement of a hand-held grinding machine, in contrast to previous solutions. Accordingly, the movement is three-dimensional in contrast to the two-dimensional movement obtained with previous solutions.

In the following description terms, such as "above", "under" etc. indicate directions in relation to the oscillating grinding machine or its constructional details as they are shown in the attached figures.

Significant advantages over the prior art are achieved with the grinding machine described in the present invention. Furthermore, by arranging the drive shaft of the grinding machine to be directly driven by the driving motor, a simple and stable construction with an easily replaceable drive shaft is achieved. On the other hand, the light and simple construction of the grinding head of the grinding machine enables the utilization of the grinding machine in grinding at high speeds of rotation.

Because the fastening surface of the fastening plate of the grinding machine is provided with a construction having a substantially spherical form, a small inclination of the grinding machine does not change the mutual geometry of the contact surfaces facing each other. Accordingly, the present grinding machine allows the inclination of the grinding product arranged in the fastening surface of the machine in relation to the grinding area to be avoided. Consequently, since a hand-held oscillating tool according to the present invention does not require an equally exact positioning to the grinding area as previously known solutions, working with the tool becomes significantly simpler. Furthermore, the fastening plate of the grinding machine is well suitable for flexible abrasives known per se.

The spherical surface of the fastening plate enables the application of a more distinct and higher grinding pressure in the middle of the contact surface of the fastening plate. The design thus enables a more exact grinding or polishing on only the defect in the current grinding area. The present solution thus results in a smaller grinding area and the edge area at the periphery of the grinding area is less visible, and a smooth interface between the finished and unfinished areas is obtained. Accordingly, the novel construction enables mainly the avoidance of troublesome semilunar or crater-like grinding defects in painted and lacquered surfaces.

The functional principle of the present invention also enables the manufacture of a grinding machine having a spherical grinding movement adapted to products having cap-shaped concave or convex surfaces that need to be ground. Thus, the grinding head of the grinding machine can easily be replaced with a concave or convex one, according to the need.

Additional advantages and details of the invention are disclosed in detail in the following description.

SUMMARY OF DRAWING FIGURES

Figure 2:
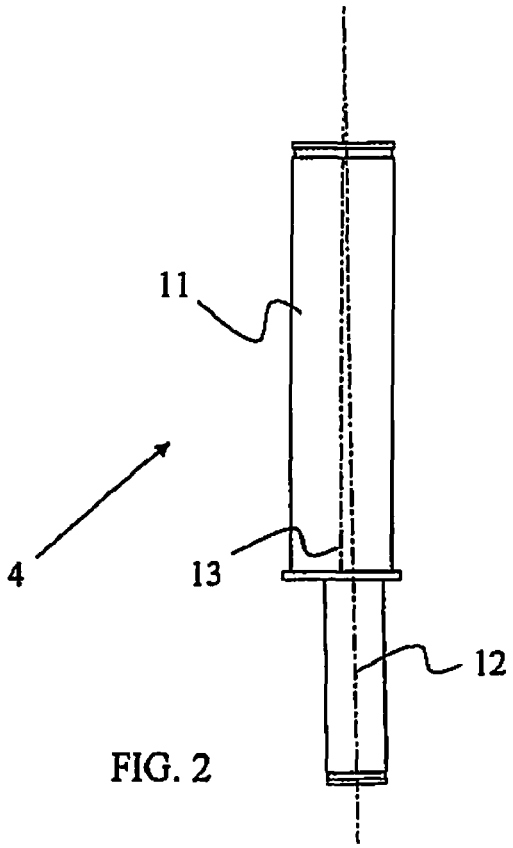
Figure 3:
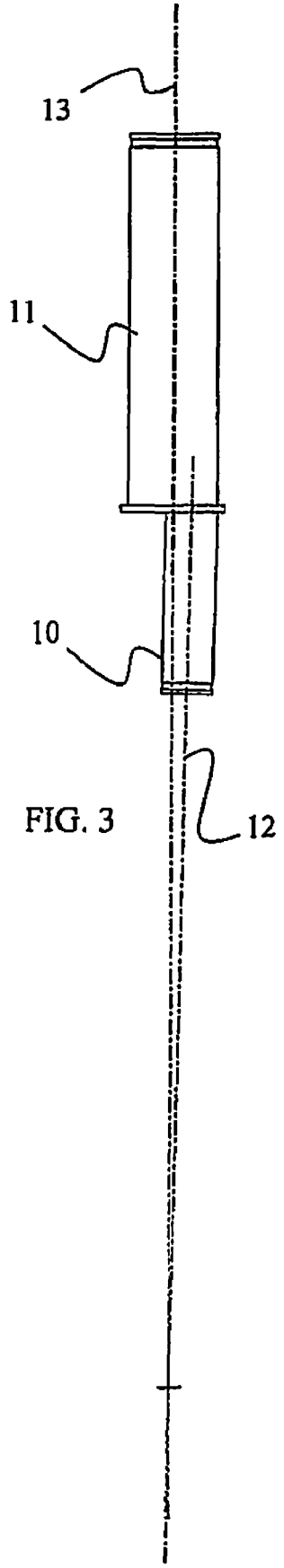

In the following, the invention will be described in more detail with reference to the drawing, in which FIG. 1 shows a vertical and schematic section of an oscillating grinding machine according to the present invention, FIG. 2 is a side view of the drive shaft of the grinding machine, and FIG. 3 is a side view of an alternative implementation of the drive shaft of the grinding machine.

PREFERRED EMBODIMENTS

Preferred embodiments of the present oscillating grinding machine are described below with reference to the above-mentioned figures. Herein, the solutions comprise the constructional parts shown in the figures, each of which are denoted with a respective reference numeral. These reference numerals correspond to the reference numerals given in the following description.

According to FIG. 1, an oscillating grinding machine comprises a stem 1 surrounding a driving motor 2 together with a body 3. The driving motor controls a drive shaft 4 that cooperates with a grinding head 5. The grinding machine may be provided with either an electric or a pneumatic driving motor, which controls the drive shaft at a suitable speed. The drive shaft rotates usually at a rotation speed of 1,000 to 12,000 rpm. The drive shaft is preferably arranged to be directly driven by the driving motor. An alternative implementation of an oscillating grinding machine for very small tasks is designed as a pencil-shaped easily handled grinding machine with small dimensions. The stem 1 may even be detachably fastened to the body 3, allowing the stem to be removed for enabling the placement of the grinding machine in a special holder of a design known per se.

The grinding head 5 is arranged to rotate freely in relation to the drive shaft 4 and the body 3 of the grinding machine by an arrangement of one or several bearing means 6 and 7 between the drive shaft and the grinding head. A grinding product 8 is arranged with mechanical fastening means, known per se, to a fastening plate 9 comprised by the grinding head.

The grinding head preferably has a simple construction that can be manufactured for instance by casting it in plastic. Consequently, the grinding head comprises a small mass enabling the utilization of the oscillating grinding machine at high speeds of rotation. The grinding head is also easy to replace such that is comprises a fastening surface having a suitable design. Thus, the grinding head may be concave or convex, according to the need.

In the present embodiment, the fastening plate 9 is arranged to obtain an oscillating movement in such a manner that it is eccentrically fastened in relation to the drive shaft 4 with an eccentric shaft 10 comprised thereby according to FIG. 3. In addition to said oscillating movement, the fastening plate also has a free rotation in relation to the eccentric shaft, since the grinding head 5 is arranged to rotate freely in relation to the eccentric shaft 10.

Consequently, the eccentric shaft 10 constitutes a part of the drive shaft 4 of the grinding machine, the eccentric shaft being arranged rigidly to a main shaft 11 comprised by the drive shaft. In this connection, the eccentric shaft comprises a centre line 12 that assumes an acute angle $\alpha$ against a corresponding centre line 13 comprised by the main shaft. Such an angularity of the eccentric shaft results in the required eccentric placement of the grinding head 5 in relation to the main shaft and a resulting eccentric movement of the fastening plate 9 comprised by the grinding head.

In the present embodiment of the grinding machine, the centre lines 12 and 13 thus diverge relative to each other, whereby the distance between the centre lines, at a grinding plane constituted by the grinding product 8 arranged in the fastening plate 9, becomes the radius of the oscillating movement of the fastening plate. Said eccentricity of the oscillation movement at the grinding plane is preferably in the order of 1 to 5 mm, typically 1 to 2.5 mm, but nothing prevents the magnitude of the oscillation movement from deviating from this. Furthermore, since said centre lines are arranged to intersect at an angle $\alpha$ at a point above the grinding plane according to FIG. 2, the centre line of the eccentric shaft provides a corresponding angle $\alpha$ with the normal of the grinding plane.

According to FIG. 3, the centre lines 12 and 13 of the eccentric and main shafts may also be arranged to intersect at an angle $\alpha$ at a point under the grinding plane. The present functional principle thus enables the manufacture of an oscillating grinding machine having a spherical grinding movement adapted to products having cap-shaped concave or convex surfaces that require grinding.

To avoid axial movements at the outer edge of the grinding plane, the fastening plane 9 is preferably designed to comprise a substantially spherical fastening surface 14 on which the grinding product may be arranged. The centre lines 12 and 13 are preferably simultaneously arranged to intersect at a finite height above the grinding plane that will correspond to the radius of the spherical oscillation plane of the fastening plate, whereby this height preferably corresponds to the bend radius of the spherical fastening surface. This radius may be suitably selected to be between 20 and 300 mm, but is in its most preferable embodiment between 75 and 150 mm. In special cases this radius may be selected exact in order to fit the curvature of the surface of a specific product and to result in an optimal grinding result.

Making the drive shaft 4 replaceable not only facilitates maintenance of the grinding machine but also facilitates the adjustment of the oscillating movement of the grinding head 5 to different requirements and to fastening plates 9 and grinding products 8 of different sizes. Upon adjustment of the oscillating movement, upon replacement of the drive shaft, an implementation is thus selected in which the centre line 12 of the eccentric shaft assumes an angle $\alpha$ in relation to the centre line 13 of the main shaft 11, which differs from said angle $\alpha$ before the replacement, or that the centre lines of the main shaft and the eccentric shaft are arranged to intersect at a point different from the point before the replacement.

The construction of the present grinding machine, wherein the grinding head 5 rotates in relation to the eccentric shaft 10, the main shaft 11 rotates in relation to the body 3 of the grinding machine and the eccentric shaft 10 is inclined in relation to the main shaft, provides an oscillation at a substantially spherical plane, which results in a very even grinding result without nicks or other irregularities. The advantage of this special oscillating movement is that, in spite of a slight inclination of the grinding machine, the oscillating movement of the grinding head, precisely at the contact point between the grinding product 8 and the grinding plane, will be kept at the plane of the fastening surface 14 as long as the inclination is within the angle cone comprised by the spherical surface plane of the fastening surface.

The description and the related figures are only intended to illustrate the present solution to the construction of an oscillating grinding machine. Consequently, the solution is not restricted only to the embodiment described above or in the attached claims, but a plurality of variations or alternative embodiments are feasible within the idea described in the attached claims.

The invention claimed is:

1. An oscillating grinding machine comprising a driving motor surrounded by a body, and a two part unitary rigid drive shaft that directly cooperates with the driving motor and comprises a grinding head as a support for a flexible grinding product, the grinding head being mounted in bearings for free rotation around the drive shaft, wherein the drive shaft extends to the driving motor and comprises a main shaft part and an eccentric shaft part connected rigidly thereto and extending from one end of said main shaft in such a manner that the eccentric shaft having a center line that assumes an angle relative to a corresponding center line comprised by the main shaft and that the grinding head is coupled to the eccentric shaft for an eccentric placement in relation to the main shaft, the grinding head being arranged to assume an oscillation in a substantially spherical plane created by the rotation of the main shaft and the eccentricity and inclination of the eccentric shaft in relation to the main shaft whereby rotational symmetric grinding can be achieved.

2. An oscillating grinding machine as claimed in claim 1, wherein the center line of the main shaft and the center line of the eccentric shaft are arranged to diverge in relation to each other so that the eccentric shaft is laterally offset.

3. An oscillating grinding machine as claimed in claim 2, wherein the center line of the main shaft and the center line of the eccentric shaft are arranged to diverge in relation to each other and wherein the end of one shaft is joined to the end of the other shaft thereby creating a single shaft with two intersecting centerlines.

4. An oscillating grinding machine as claimed in claim 2, wherein the center line of the main shaft and the center line of the eccentric shaft are arranged to intersect at a finite height above the grinding product arranged in a fastening plate comprised by the grinding head.

5. An oscillating grinding machine as claimed in claim 4, wherein the center line of the main shaft and the center line of the eccentric shaft are arranged to intersect at a point between 20 and 300 mm above the grinding product arranged in the fastening plate.

6. An oscillating grinding machine as claimed in claim 5, wherein the center line of the main shaft and the center line of the eccentric shaft are arranged to intersect at a point between 75 and 150 mm above the grinding product arranged in the fastening plate.

7. An oscillating grinding machine as claimed in claim 2, wherein the center line of the main shaft and the center line of the eccentric shaft are arranged to intersect at a point situated at a finite distance under the grinding product arranged in a fastening plate comprised by the grinding head.

8. An oscillating grinding machine comprising:

a driving motor surrounded by a body, and a drive shaft that directly cooperates with the driving motor and comprises a grinding head as a support for a flexible grinding product, the grinding head being mounted in bearings for free rotation around the drive shaft, wherein the drive shaft extends to the driving motor and comprises a main shaft and an eccentric shaft arranged rigidly thereto in such a manner that the eccentric shaft comprises a center line that assumes an angle against a corresponding center line comprised by the main shaft and that the grinding head is arranged to the eccentric shaft for an eccentric placement in relation to the main shaft, whereby the grinding head is arranged to assume an oscillation in a substantially spherical plane created by the rotation of the main shaft and the eccentricity and inclination of the eccentric shaft in relation to the main shaft, and wherein the center line of the main shaft and the center line of the eccentric shaft are arranged to intersect at a point situated at a distance above or under the surface of the grinding product that produces the spherical grinding movement corresponding to the curvature of the surface to be ground.

9. An oscillating grinding machine as claimed in claim 8, wherein the fastening surface of the fastening plate has a bend radius that substantially corresponds to the radius of the spherical oscillation plane of the grinding head.

10. An oscillating grinding machine as claimed in claim 8, wherein the drive shaft of the grinding machine is replaceable.

11. An oscillating grinding machine as claimed in claim 8, wherein the grinding head comprises a fastening plate having a substantially spherical fastening surface for receiving the grinding product.

12. An oscillating grinding machine as claimed in claim 8, wherein the shaft rotates at a 1000-2000 rpm.

13. A hand-held grinding machine, comprising:

a body;

a driving motor a replaceable drive shaft rotatable with respect to the body, the drive shaft comprising:

a first part including a main shaft controlled directly by the driving motor; and a second part extending from an end of the first part and including:

an eccentric shaft rigidly attached to the main shaft;

wherein the main and eccentric shafts have respective center lines that intersect are angularly displaced; and wherein said drive shaft is replaceable with drive shafts having different angular displacements; and a replaceable grinding head fastened to the eccentric shaft by bearing means and freely rotatable around the eccentric shaft, the grinding head comprising:

a fastening plate for mechanically holding a grinding product.

14. The hand-held grinding machine of claim 13, wherein the drive shaft is replaceable by a replacement drive shaft having a different angular displacement between its main and eccentric shafts.

15. The hand-held grinding machine of claim 13, wherein the drive shaft is replaceable by a replacement drive shaft having a different intersection point between the center lines of its main and eccentric shafts.

16. The hand-held grinding machine of claim 13, wherein the fastening plate is spherical.

17. The hand-held grinding machine of claim 13, wherein the fastening plate is convex.

18. The hand-held grinding machine of claim 13, wherein the fastening plate is concave.

19. The hand-held grinding machine of claim 13, wherein the grinding head is replaceable by a replacement grinding head having a different radius of curvature on its fastening plate.

20. The hand-held grinding machine of claim 13, wherein the driving motor is electric.

21. The hand-held grinding machine of claim 13, wherein the driving motor is pneumatic.

* * * * *